US009204762B2

(12) United States Patent
McLeod

(10) Patent No.: US 9,204,762 B2
(45) Date of Patent: Dec. 8, 2015

(54) DRAIN CLOSURE DEVICE

(75) Inventor: Christopher Adam McLeod, Toronto (CA)

(73) Assignee: Oakville Stamping & Bending Ltd. (CA)

( * ) Notice: Subject to any disclaimer, the term of this patent is extended or adjusted under 35 U.S.C. 154(b) by 877 days.

(21) Appl. No.: 13/214,179

(22) Filed: Aug. 20, 2011

(65) Prior Publication Data

US 2013/0042398 A1 Feb. 21, 2013

(51) Int. Cl.
*A47K 1/14* (2006.01)

(52) U.S. Cl.
CPC ..... *A47K 1/14* (2013.01)

(58) Field of Classification Search
USPC ..... 4/286–295
See application file for complete search history.

(56) References Cited

U.S. PATENT DOCUMENTS

| | | | | |
|---|---|---|---|---|
| 3,468,512 | A * | 9/1969 | Politz | 251/74 |
| 4,007,500 | A * | 2/1977 | Thompson et al. | 4/295 |
| 4,359,788 | A * | 11/1982 | Liou | 4/287 |
| 4,876,749 | A * | 10/1989 | Antoniello | 4/295 |
| 5,072,461 | A * | 12/1991 | Logsdon | 4/295 |
| 2011/0138527 | A1 * | 6/2011 | Siena et al. | 4/295 |

* cited by examiner

*Primary Examiner* — Lauren Crane
(74) *Attorney, Agent, or Firm* — Harness, Dickey & Pierce, P.L.C.

(57) ABSTRACT

A drain closure device for a vessel such as a bathtub or sink is provided. The drain closure device comprises a stopper fitted with a sealing gasket and threaded onto a stem slidably mounted in a guide member which is in turn threaded into a strainer mounted in a hole in the bottom of the vessel. The device is concentrically disposed within the strainer. Twirling of the stopper causes the stem to rise and fall against an undulating cam surface of the guide. Resistance to closure is provided by rest stops for projections on the upper part of the stem. No spring, pins, or resistance seals are used. Once in place, the drain closure nests in the strainer.

15 Claims, 4 Drawing Sheets

DRAIN CLOSURE DEVICE

FIELD OF INVENTION

The present invention relates generally to drain closure devices and more particularly to drain closure devices having a mechanism for guiding the device between an open and a closed configuration.

BACKGROUND OF THE INVENTION

A vessel such as a bathtub or a sink is typically emptied through a drainage passage extending therethrough.

The drainage passage typically has a closure device associated with it. The closure device is typically moveable between a closed configuration which blocks fluid flow through the passage and an open configuration which allows fluid flow through the passage.

The passage is generally provided with a strainer which is basically an externally threaded tube insertable through the passage with a flange extending radially outwardly about an upper end thereof.

The strainer may include one or more members extending across the tube and defining apertures which are smaller in area than the cross sectional area of the tube. As the name suggests, the strainer will prevent objects above a certain size from passing through the tube. Commonly strainers have a "cross-hair" shaped member extending across the tube to define four apertures and a central opening which is threaded.

The flange or the strainer extends about the passage for sealing engagement with the vessel. The strainer is held in place by an internally threaded lower member which threadedly engages the tube and presses against the vessel to pull the flange tightly against the vessel.

The closure device typically interacts with the strainer. Early closure devices were simply plugs or stoppers removably insertable into the strainer to block the strainer. More modern closure devices interface with the upper flange rather than the strainer tube and utilize a gasket which is pressed against the flange to effect sealing in the closed configuration. Such devices typically include some mechanism for maintaining the gasket and the flange spaced apart in the open configuration.

SUMMARY OF THE INVENTION

The present arrangement utilizes a cam and cam follower arrangement for guiding movement of a stopper relative to a guide member mounted to the strainer.

More particularly, a drain closure device is provided for mounting to a strainer which defines a fluid passage with a flange extending outwardly about an upper end thereof. The drain closure device has a stopper with a sealing member for sealing against the flange and a stem depending from the stopper. The stem and the stopper are rotatable about a stopper axis. The device includes a guide member defining a sleeve extending about and receiving at least a portion of the stem for relative rotational and longitudinal sliding movement between the guide member and the stem respectively about and along the stopper axis. The guide member further defines an upper cam surface. A cam follower extends from the stem for following the cam surface in response to rotation of the stopper about the stopper axis. The cam surface is profiled to cause axial movement of the sealing member between an open configuration away from the guide member (i.e. with the sealing member away from the flange to permit fluid flow) and a closed configuration toward the guide member (i.e. with the sealing member in sealing engagement with the flange to impede fluid flow). The cam surface includes a detent for maintaining the stopper in the open configuration absent rotational input to the stopper. The guide member further has securing means for securing the guide member to the strainer.

The sealing member may include a gasket affixed to it for sealing against the flange in the closed configuration to impede fluid flow into the passage.

The stem may be provided with a retainer for acting against the guide member for retaining the stopper in the guide member.

The retainer may be a threaded fastener mounted to a threaded lower end of the stem, distal the sealing member.

The securing means for securing the guide member to the strainer may be a threaded end of the guide member distal the cam for threadedly engaging the strainer.

DESCRIPTION OF THE DRAWINGS

Preferred embodiments of the present invention are set out below with reference to the accompanying illustration in which.

DESCRIPTION OF PREFERRED EMBODIMENTS

Figure 1:
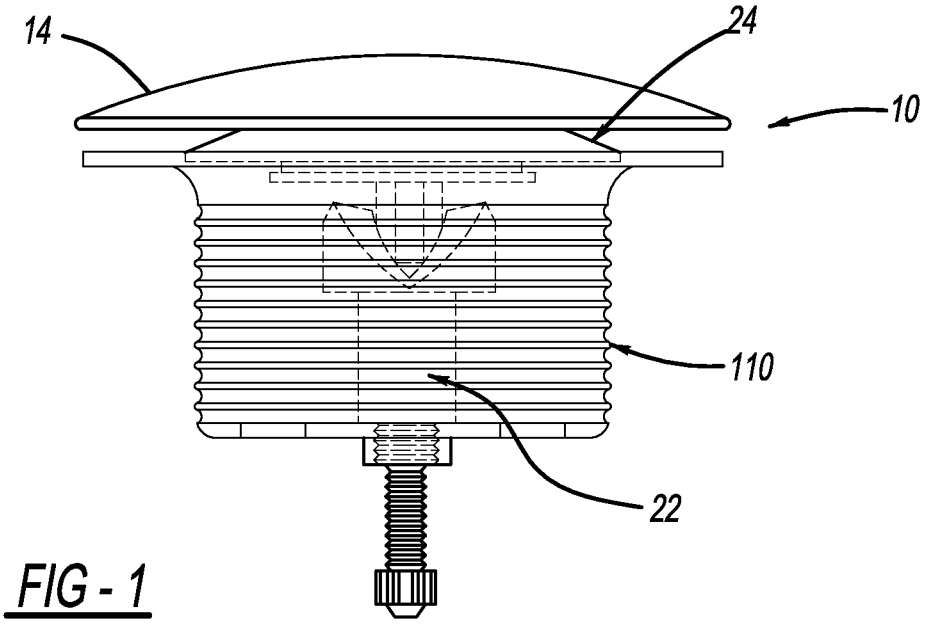
FIG. 1 is a front elevation of a drain closure assembly according to the present invention in association with a strainer in a closed configuration.

A drain closure device according to the present invention is generally indicated by reference 10 in the accompanying illustrations. The drain closure device is mountable to a strainer 100 in FIGS. 1 and 2 which defines a fluid passage 102 for draining a vessel such as a sink or a bathtub (not shown) to which it is mounted. The strainer has a flange 104 extending radially outwardly about an upper end 106 thereof. The strainer has a tubular body 108 which has external threads 110 insertable through an aperture in a wall of the vessel. The threads interact with an internally threaded fastener (not shown) for securing the strainer 100 to the vessel.

The drain closure device 10 has a stopper 12 (FIG. 3) having a sealing member 14 for sealing against the flange 104 and a stem 16 depending from the stopper. The stem 16 and sealing member 14 are rotatable about a stopper axis 18.

A guide member 20 having a sleeve 22 extends about and slidably receives at least a portion of the stem 16. The stem 16 is axially slidable relative to the guide member 20 along the stopper axis 18. The stem 16 is further rotatable relative to the guide member 20 about the stopper axis 18.

Figure 6:
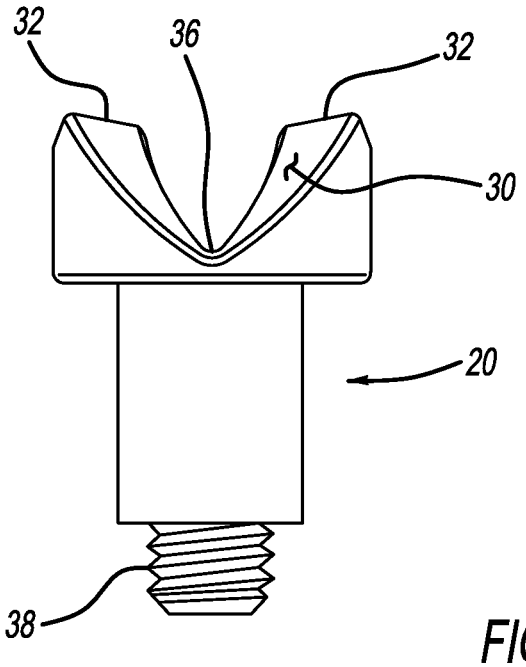
FIG. 6 is a front elevation of a guide member portion of a drain closure assembly according to the present invention; and, FIG. 7 is an end elevation corresponding to FIG. 6.
Figure 7:
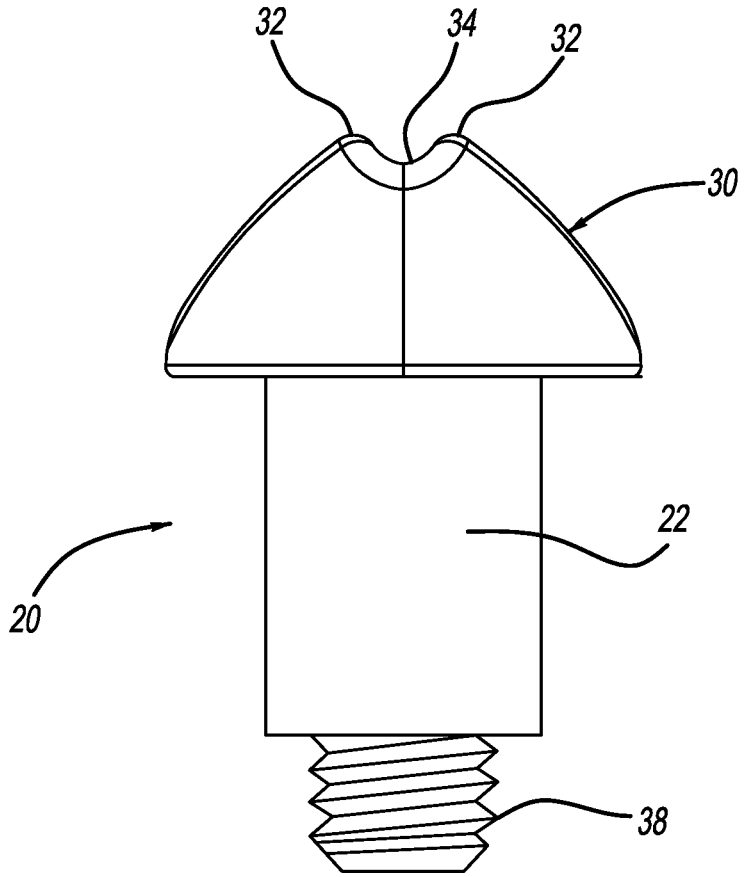

The guide member 20 has an upper cam surface 30 with an undulating profile having peaks 32 (FIGS. 6 and 7), upper valleys 34 and lower valleys 36.

Figure 2:
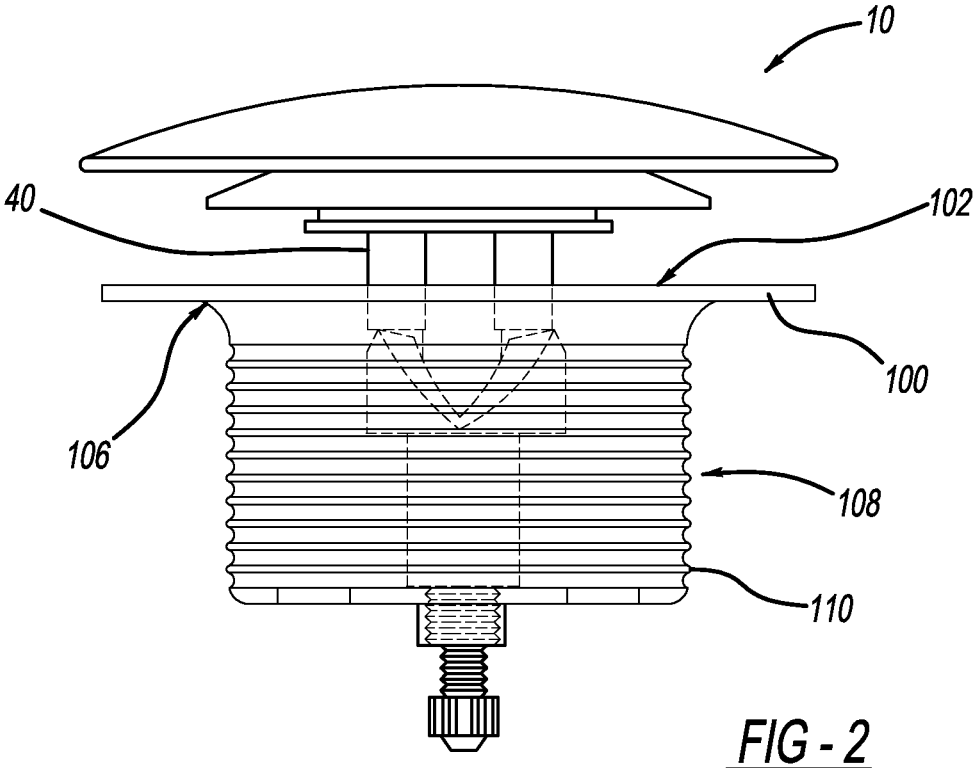
FIG. 2 corresponds to FIG. 1 but shows the drain closure assembly in an open configuration.
Figure 3:
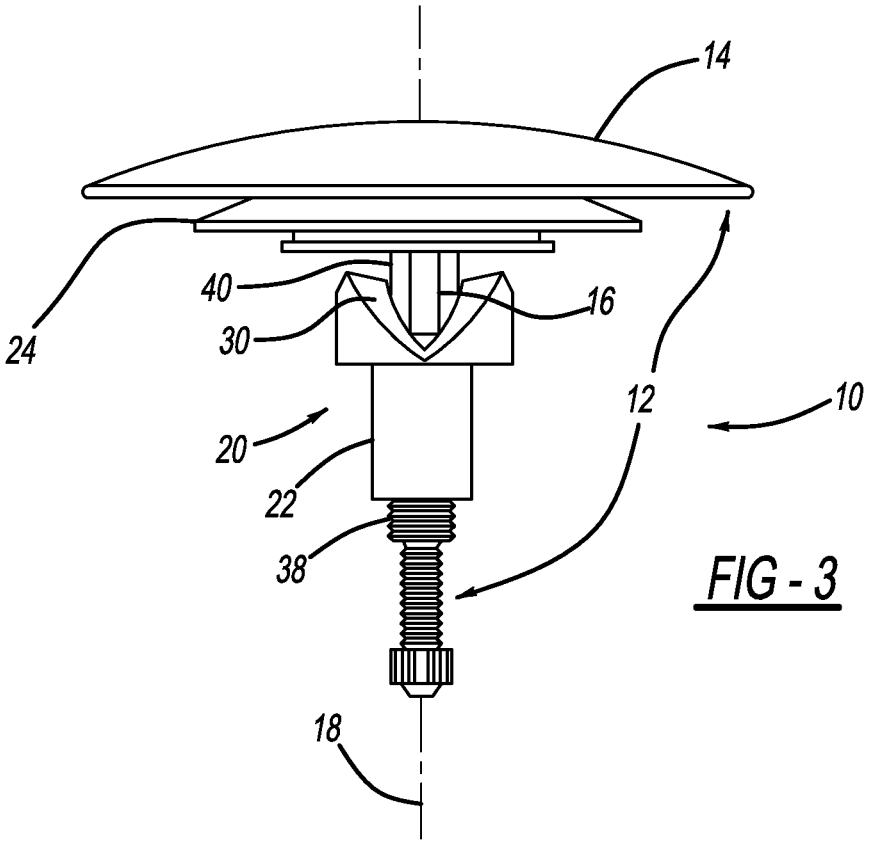
FIG. 3 is a front elevation of the drain closure assembly without the strainer in a closed configuration.
Figure 4:
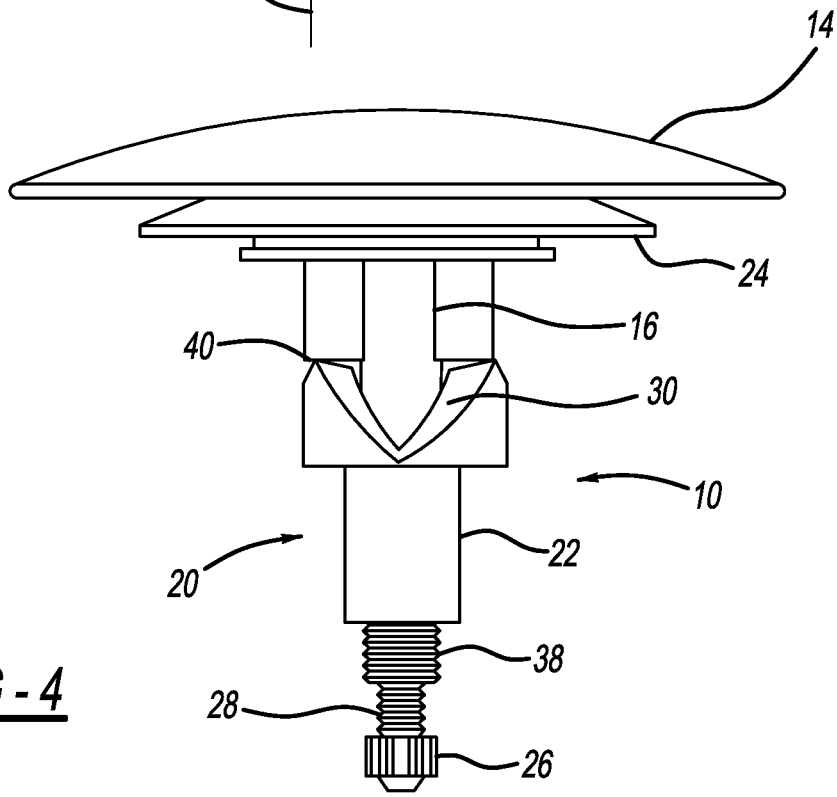
FIG. 4 corresponds to FIG. 3 but shows the drain closure assembly in a closed configuration.

A cam follower 40 extends from the stem 16. The cam follower 40 follows the cam surface 30 in response to the rotation of the stopper 12 about the stopper axis 18. The cam surface 30 is profiled to cause axial movement of the sealing member 14 between an open configuration away from the guide member 20 and flange 104 (FIGS. 2 and 4) and a closed configuration toward the guide member 20 and flange 104 (FIGS. 1 and 3).

In the closed configuration, the cam follower 40 rests in the lower valley 36. In the open configuration, the cam follower 40 rests in the upper valleys 34. The upper valleys 34 act as a detent for maintaining the stopper 12 in the open configuration absent further rotational force to cause the cam followers 40 to rise out of the upper valley 34.

The guide member 20 has a threaded end 38 for securing the guide member 20 to the strainer 100.

The sealing member 14 may be provided with a gasket 24 for sealing against the flange 104 in the closed configuration (as illustrated in FIG. 1) to impede fluid flow into the passage 102.

If it is desired to avoid having the stopper 12 simply lift out of the guide member 20, a retainer may be provided to retain the stopper 12 in the guide member 20. In the illustrated embodiment the retainer is a threaded fastener or nut 26 which threads onto a threaded lower end 28 of the stem 16 which is distal the sealing member 14. The nut 26 acts against the guide member 30 to impede withdrawal of the stem 16 from the sleeve 22.

Figure 5:
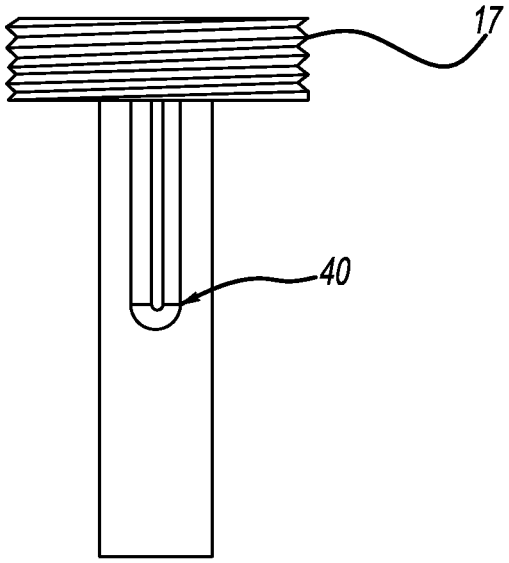
FIG. 5 is a front elevation of a stem portion of a stopper of a drain closure assembly according to the present invention.

The stem 16 may be provided with an upper threaded portion 17 (see FIG. 5) for threaded connection to the sealing member 14.

As can be seen from the illustrations, operation of the drain closure device is simply effected by rotation of the stopper 12 which causes the cam follower 40 to ride up and down along the cam surface 30 to cause reciprocal movement (raising and lowering) of the stopper 12 relative to the guide member 20, and in turn the flange 104 to which the guide member 20 is secured via securement to the strainer 100. The stopper 12 is urged toward the guide member 20 by its weight (gravity) thereby avoiding the use of springs. Water pressure ("head") holds the sealing member 14 against the flange in the closed configuration. The upper valleys 34 hold the cam followers 40 and in turn the stopper in the open configuration against the head of water. The device 10 is simple, efficient and robust.

The above description is intended in an illustrative rather than a restrictive sense. Variations to the preferred embodiments described may be apparent to persons skilled in the art without departing from the spirit or scope of the invention as defined by the claims set out below.

The invention claimed is:

1. A drain closure device for mounting to a strainer defining a fluid passage with a flange extending outwardly about an upper end thereof, said drain closure device comprising:

a stopper having a sealing member for sealing against said flange and a stem depending from said stopper, said stem and said stopper being rotatable about a stopper axis;

a guide member defining a sleeve for extending about and receiving at least a portion of said stem for relative rotational and longitudinal sliding movement therebetween respectively about and along said stopper axis;

said guide member further defining a continuous upper ramped cam surface;

a cam follower extending from said stem for following said ramped cam surface in response to rotation of said stopper about said stopper axis, said ramped cam surface being profiled to cause axial movement of said sealing member between an open configuration away from said guide member and a closed configuration toward said guide member, said cam follower held in contact with said ramped cam surface solely by gravity forcing said cam follower downward and against said ramped cam surface, said ramped cam surface remains stationary as said cam follower moves along said ramped cam surface during movement of said sealing member between the open configuration and the closed configuration;

said ramped cam surface including a detent for maintaining said stopper in said open configuration absent rotational input to said stopper; and said guide member further having a securing component configured to secure said guide member to said strainer.

2. A drain closure device as claimed in claim 1 wherein said sealing member has a gasket affixed thereto for sealing against said flange in said closed configuration to impede fluid flow into said passage.

3. A drain closure device as claimed in claim 2 wherein said stem is provided with a retainer for acting against said guide member retaining said stopper in said guide member.

4. A drain closure device as claimed in claim 3 wherein said retainer is a threaded fastener mounted to a threaded lower end of said stem, distal said sealing member.

5. A drain closure device as claimed in claim 1 wherein said securing component configured to secure said guide member is a threaded end of said guide member distal said cam for threadedly engaging said strainer.

6. A drain closure as claimed in claim 4 wherein said securing component configured to secure said guide member is a threaded end of said guide member distal said cam for threadedly engaging said strainer.

7. A drain closure device configured to be mounted to a strainer, the strainer defining a fluid passage and including a flange extending outwardly about an upper end thereof, the drain closure device comprising:

a stopper including:

a sealing member configured to seal against the flange of the strainer;

a stem extending from the stopper, the stem rotatable about a stopper axis; and a cam follower extending from an outer diameter of the stem; and a guide member defining a sleeve through which the stopper extends, the guide member including a plurality of continuous ramped cam surfaces each extending between a peak and a lower valley of the guide member, the peak is closer to the sealing member than the lower valley, an upper valley is defined between two neighboring peaks, a securing component of the guide member is configured to secure the guide member to the strainer in a stationary, non-rotatable manner;

wherein:

in a closed position the sealing member of the stopper seals against the flange of the strainer, and the cam follower is seated at the lower valley between two of the ramped cam surfaces;

rotation of the stopper rotates the stem about the stopper axis such that the cam follower moves out of the lower valley and slides up the cam surface to the upper valley between neighboring peaks, thereby slidably moving the stem along the stopper axis and moving the sealing member apart from the flange of the strainer to arrange the drain in an open position;

the cam follower is held in contact with the cam surface solely by gravity forcing the cam follower downward and against the cam surface; and the guide member and the plurality of ramped cam surfaces thereof remain stationary as the sealing member is moved between the closed position and the open position.

8. The drain closure device of claim 7, wherein the guide member includes four ramped cam surfaces, two upper valleys between neighboring peaks, and two lower valleys.

9. The drain closure device of claim 7, wherein the cam follower is rounded.

10. The drain closure device of claim 7, wherein the stopper includes a gasket configured to seal against the flange in the closed position.

11. The drain closure device of claim 7, wherein the securing component is a threaded surface configured to cooperate with threads of the strainer.

12. The drain closure device of claim 7, wherein each one of the ramped cam surfaces is curved.

13. The drain closure device of claim 7, wherein the stem includes a retention device configured to cooperate with the guide member to restrict the stem from moving entirely out from within the sleeve of the guide member.

14. The drain closure device of claim 13, wherein the retention device is a nut threaded to a distal end of the stem.

15. The drain closure device of claim 7, wherein the strainer is externally threaded.

* * * * *